US005463961A

United States Patent [19]

Graves

[11] Patent Number: 5,463,961

[45] Date of Patent: Nov. 7, 1995

[54] MOTORIZED TRACK GUIDED VEHICLE FOR INFANTS WITH SOOTHING TRACK BUMPS

[76] Inventor: Jodie B. Graves, 603 SE. 41st St., Apt. B, Lawton, Okla. 73501

[21] Appl. No.: 161,413

[22] Filed: Dec. 6, 1993

[51] Int. Cl.[6] ..... A63G 31/02

[52] U.S. Cl. ..... 104/53; 104/139; 104/302

[58] Field of Search ..... 104/53, 139, 249, 104/295, 302; 105/29.1

[56] References Cited

U.S. PATENT DOCUMENTS

| | | | |
|---|---|---|---|
| 1,165,898 | 12/1915 | Peck | 104/139 X |
| 1,370,385 | 3/1921 | Unger | 104/139 X |
| 2,888,086 | 5/1959 | O'Brien | 104/302 |
| 3,675,586 | 7/1972 | Haddad | 104/302 X |
| 4,991,516 | 2/1991 | Rixen et al. | 104/139 X |

*Primary Examiner*—Robert J. Oberleitner
*Assistant Examiner*—S. Joseph Morano
*Attorney, Agent, or Firm*—Alfred F. Hoyte, Jr.

[57] ABSTRACT

A motorized amusement device especially designed for infants is provided. The device includes a truck assembly for securing a pre-existing infant support device such as a car seat. A reconfigurable track assembly is provided so that the device can be used without rearranging existing decor. The device can be operated by remote control and includes aumtomatic safety features.

5 Claims, 7 Drawing Sheets

MOTORIZED TRACK GUIDED VEHICLE FOR INFANTS WITH SOOTHING TRACK BUMPS

The present invention relates to a motorized vehicle for infants and associated track assembly.

Motorized recreational vehicles which are disposed on a track are well known. These vehicles are generally large enough to carry several occupants and typically are capable of relatively high speed (e.g. roller coaster). While these arrangements are generally satisfactory for transporting adults and young children they are not adaptable for use with infants.

SUMMARY OF THE INVENTION

It is an object of this invention to provide a motorized vehicle which can be used as an amusement device for infants.

It is another object of this invention to provide a motorized vehicle for infants which moves along a reconfigurable track.

It is another object of this invention to provide a motorized vehicle for infants which can be operated by remote control.

It is another object of this invention to provide a motorized vehicle for infants which is reversible.

It is yet another object of this invention to provide a motorized vehicle for infants which is capable of transmitting vibration to the occupants.

It is still another object of the invention to provide a motorized vehicle for infants which has an anti-rollover feature.

It is another object of the invention to provide a motorized vehicle for infants which has interchangeable seats.

DETAILED DESCRIPTION

Figure 1:
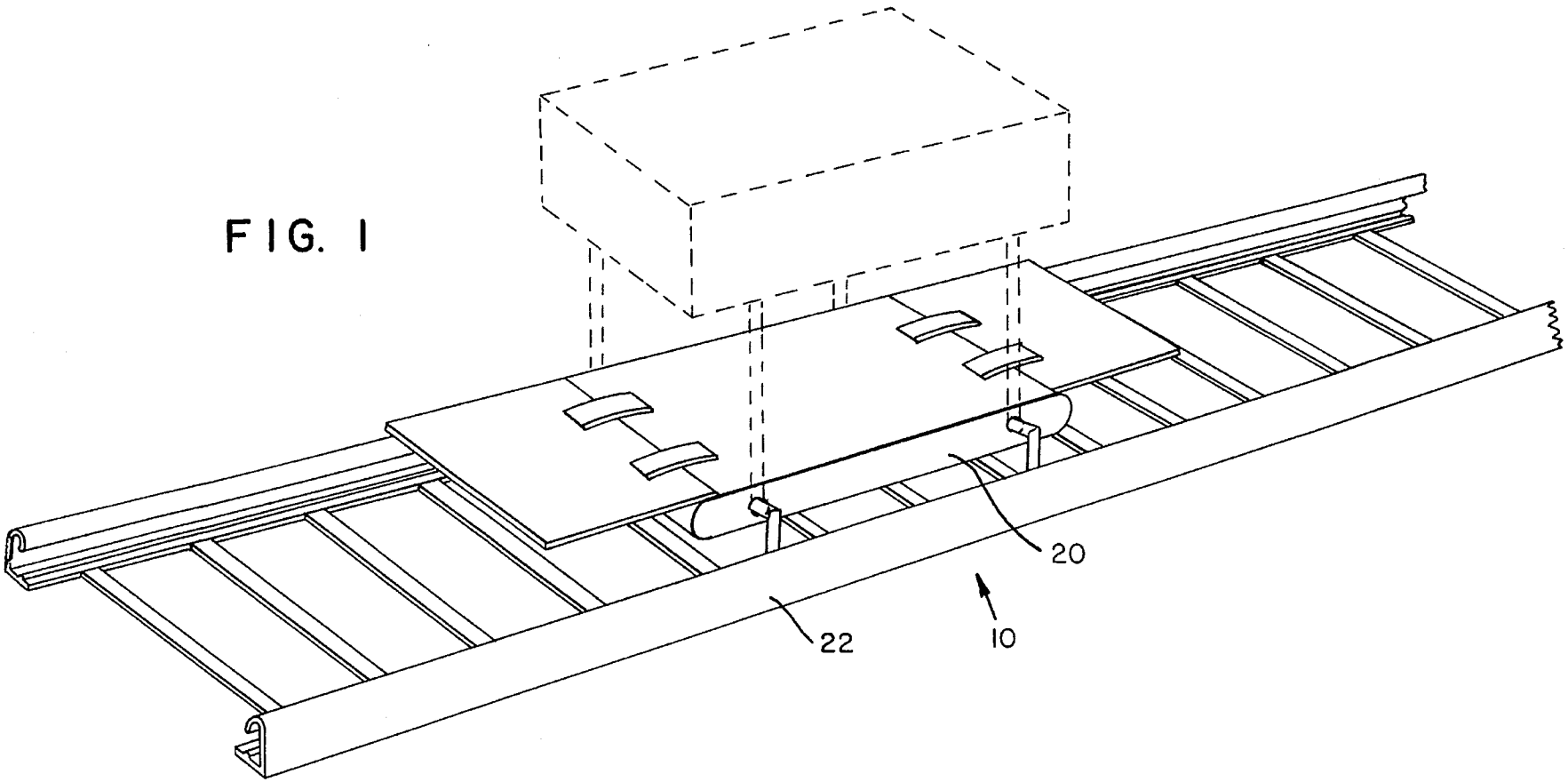
FIG. 1 shows a perspective view of the present invention mounted on a section of track.

Referring now to FIG. 1, a perspective view of the present invention, 10 is shown. The invention comprises a truck assembly 20 which rides along the track 22 and is capable of supporting various types of known infant supporting devices.

Figure 2:
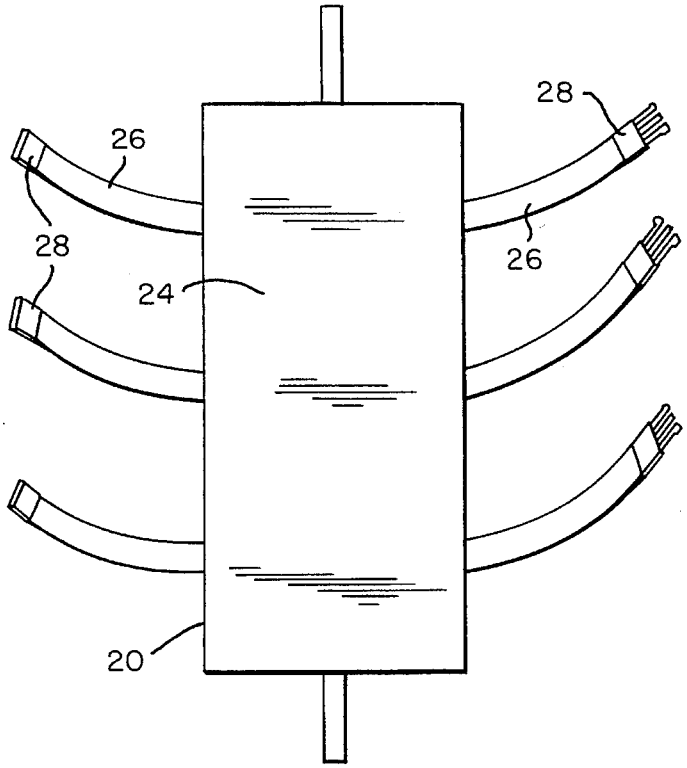
FIG. 2 shows a top view of the present invention.

Referring to FIG. 2, a top view of the truck assembly 20 is shown. The truck assembly has a top surface 24. Connected to the top surface 24 are a plurality of fastening belts 26 for securing an infant support device such as a baby carrier, car seat, bassinet or the like. The belts 26 include connectors 28 and are adjustable to accommodate infant support devices having different dimensions.

Figure 3A:
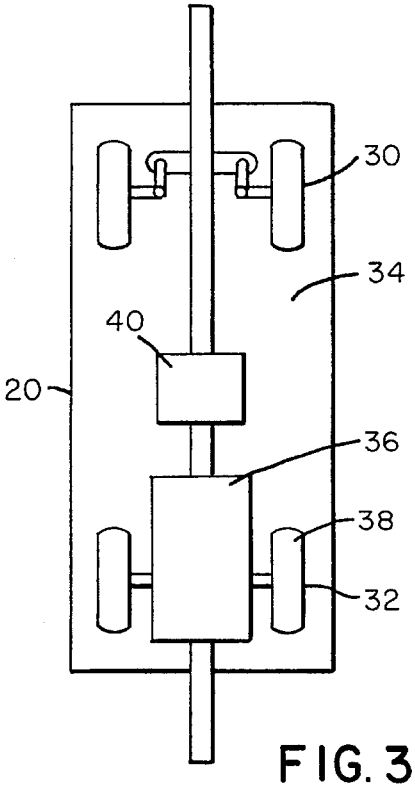
FIG. 3*a* shows the underside of the present invention.

FIG. 3*a* shows the underside of the truck assembly 20 which is supported by front 30 and rear 32 suspension assemblies which are connected to the underside 34 of the truck assembly 20. The truck assembly 20 includes a motor 36 which is mounted over the rear suspension assembly 32 so as to supply power to the rear wheels 38 for propelling the truck assembly 20.

Figure 3B:
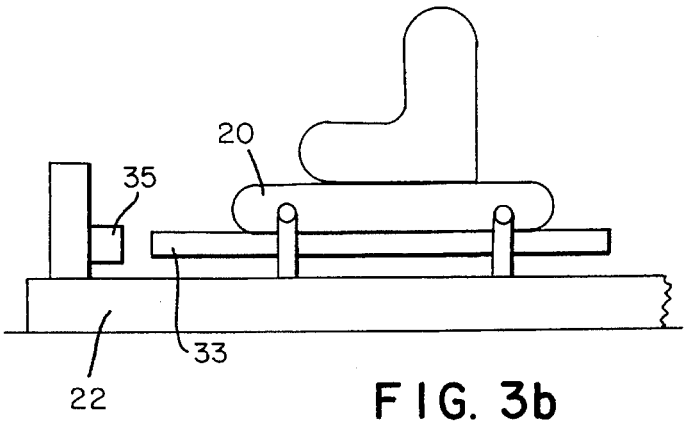
FIG. 3*b* shows the stopper arrangement.

FIG. 3*b* shows a closeup of the stopper 33 of the truck assembly 20. The stopper 33 and the end of track stop 35 cooperate to prevent the truck assembly 20 from rolling off the end of the track 22. Both the track stop 35 and the stopper 33 can either be spring loaded or made of a hard rubber to provide a cushioning effect when the truck assembly 20 reaches the end of the track 22.

The motor 36 is capable of reversal so that the truck assembly 20 can be operated in the forward or reverse direction. Reversal can be effected by way of a toggle switch (not shown) or by way of a reverse gear mechanism as is well known in the art.

In the preferred embodiment motor 36 is an electric motor powered by a battery 40.

Figure 4:
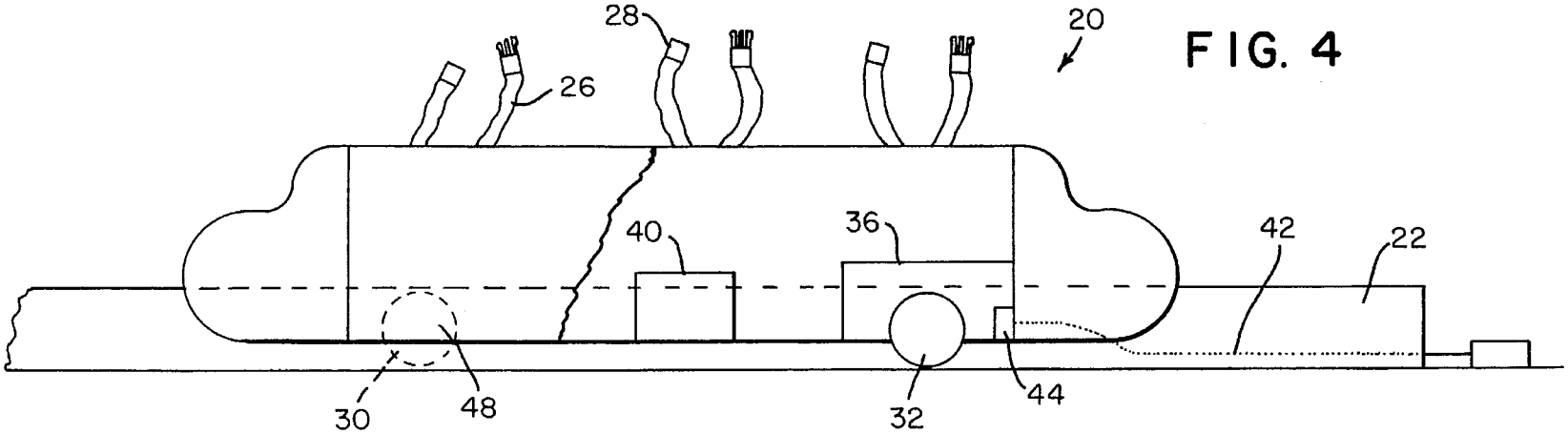
FIG. 4 shows a side view of the present invention with a cutaway portion showing the battery and motor.

FIG. 4 is a side view of the truck assembly mounted on a section of the track 22. A cutaway portion shows the position of the battery 40 and the motor 36. Also shown is a self reeling cord 42 and the associated reel assembly 44. The cord 42 is connected to a remote control 46 which will be described later. The reel assembly 44 is mounted behind the rear wheel assembly 32 so that the cord 42 does not get tangled with the wheel assemblies 30, 32.

The reel assembly 44 operates in combination with the motor 36 to keep the cord 42 from developing slack. The reel assembly 44 is spring loaded so that the amount of cord 42 reeled or unreeled is proportional to the travel of the truck assembly 20.

Figure 5:
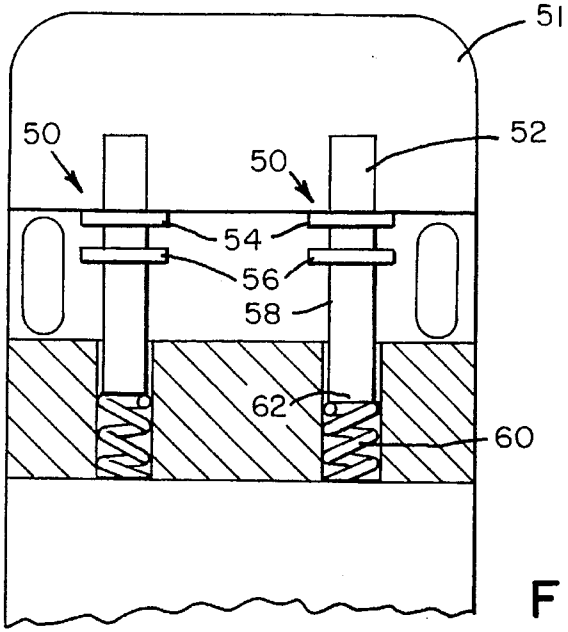
FIG. 5 shows a frontal view of the present invention and the details of the spring loaded safety contact arrangement.

FIG. 5 shows a contact assembly 50 which acts as a safety feature. The contact assembly 50 is operatively connected to the front bumper assembly 51 so that it is disengaged when the front bumper 51 contacts any object in the track 22. The contacts 54 and 56 are electrically connected to a conductor arrangement (not shown) which supplies power from the battery 40 to the motor 36. The truck assembly 20 will not move unless the obstruction is removed causing contacts 54 and 56 to touch thereby allowing electrical current to flow from the battery 40 to the motor 36.

Figure 6:
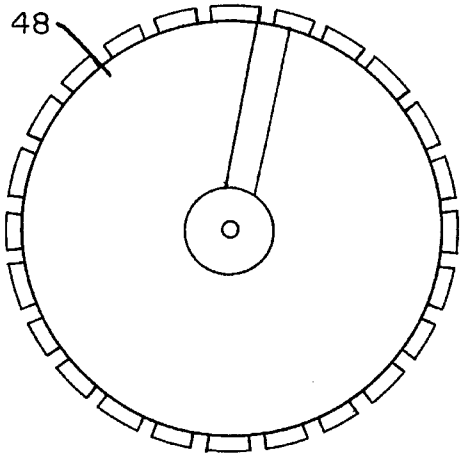
FIG. 6 shows a side view of a wheel which can be used with the present invention.

FIG. 6 shows a side view of one embodiment of a wheel 48 which can be used with the present invention. The wheel 48 has a plurality of transversally extending raised rectangular sections 66. These raised sections 66 serve to transmit vibration to the truck assembly 20 and ultimately to the infant support device. The vibration provides a soothing effect on the infant.

Figure 7:
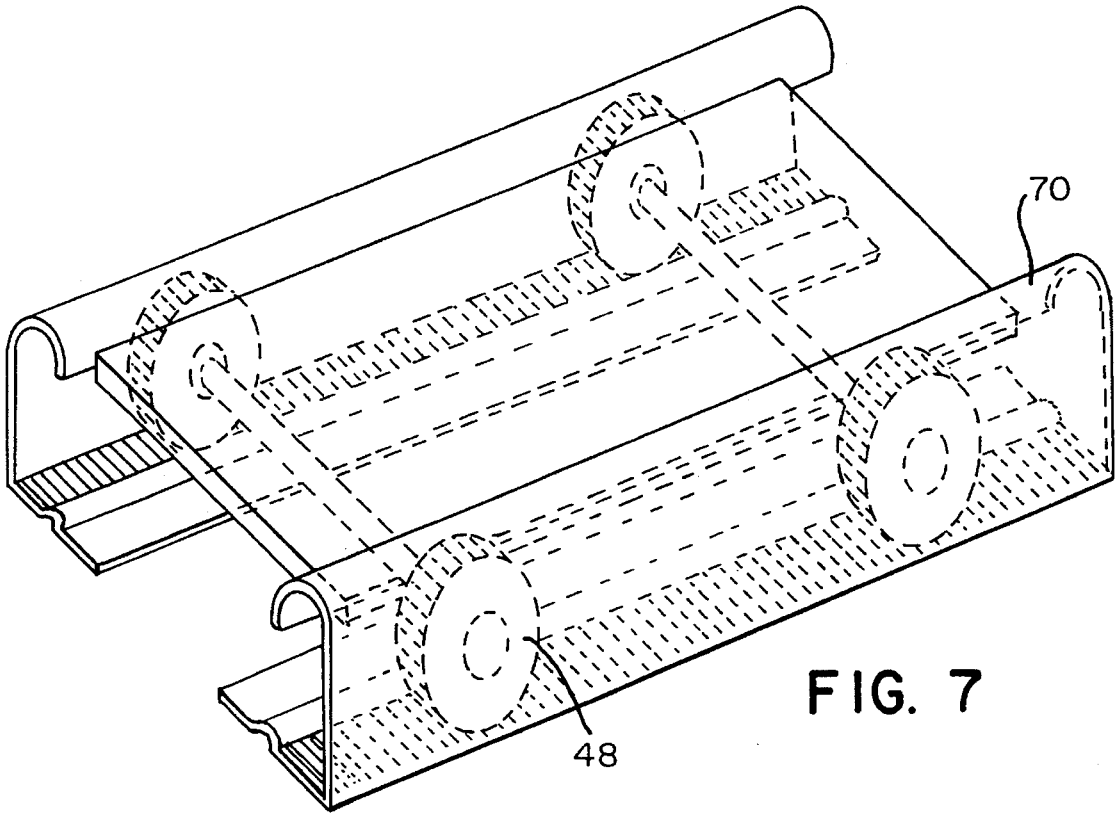
FIG. 7 shows a perspective view of the platform associated with the present invention mounted along a section of track with a cutaway portion showing the way the wheels are disposed inside the rails.

FIG. 7 shows a closeup of the truck assembly 20 with the wheels 48 mounted inside the rails 70. As can be seen the wheels 48 fit completely inside the rails 70.

Figure 8:
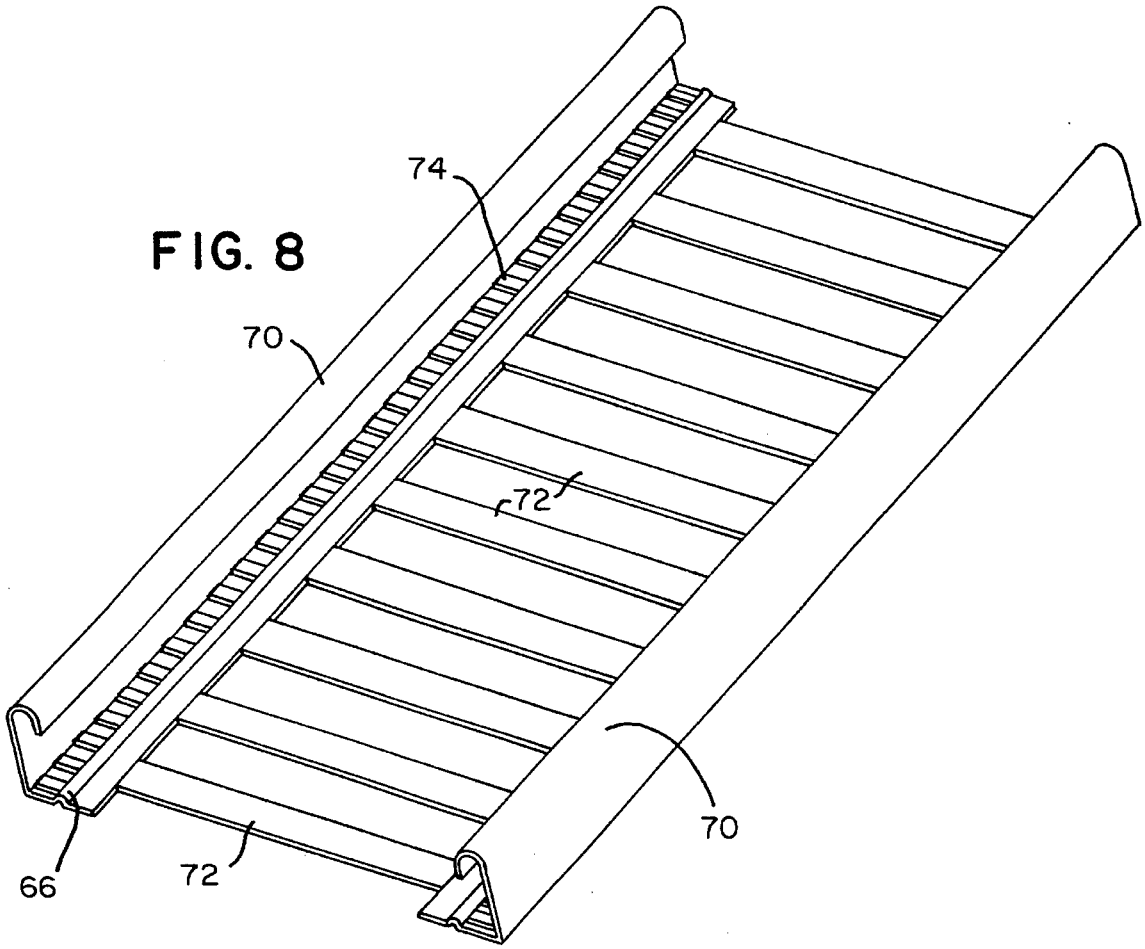
FIG. 8 shows a perspective view of the track assembly.

Referring now to FIG. 8 the track 22 comprises two rails 70 which are connected by a series of evenly spaced ties 72 which serve to stabilize the rails 70 as well as keep them evenly spaced. The rails 70 can be provided with a series of rectangular raised sections 74 which serve to impart vibration in the same manner as raised sections 66. Also the rails 70 have large ends and small ends to facilitate connecting of rails 70 as will be explained later.

Figure 9A:
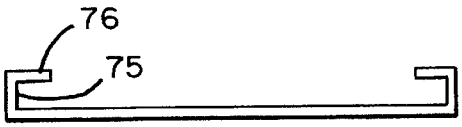
FIGS. 9*a–b* show shows the connectors for connecting the track rails.
Figure 9B:
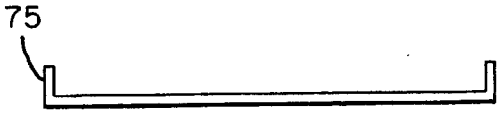

Ties 72 can be provided with a horizontally extending lip 76 or with a vertical support member 75 as shown in FIGS. 9(*a*) and (*b*).

Figure 10:
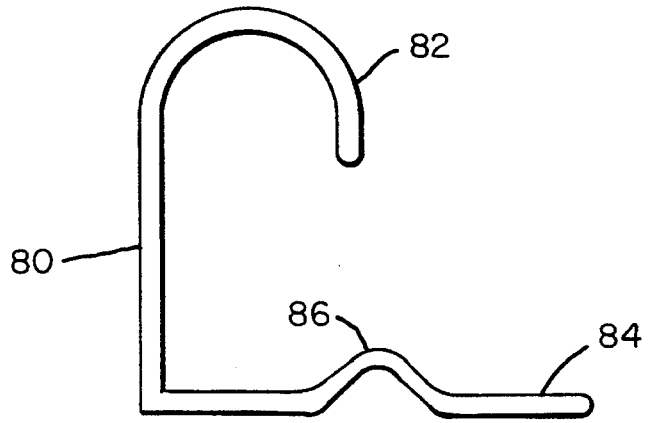
FIG. 10 shows a cross section of the rail.

FIG. 10 shows a cross sectional view of a rail 70. The rail 70 has a vertically extending wall 80 which has a downwardly extending arc shaped portion 82 which is adapted to receive the wheel 48. Rail 70 also has an integrally formed horizontally extending section 84 which provides a surface for wheel 48. The horizontal section 84 has a centrally located raised portion 86 which serves as a retainer wall for the wheels 48. Thus wheels 48 are secured onto the rails 70 by way of wall 80, arc shaped portion 82, and raised portion 86. It can be appreciated that arc shaped portion 82 acts to prevent the truck assembly 20 from tipping over since the wheels have only limited range of vertical motion. The rails 70 can be made of any suitable rigid material such as steel or other metal.

Figure 11:
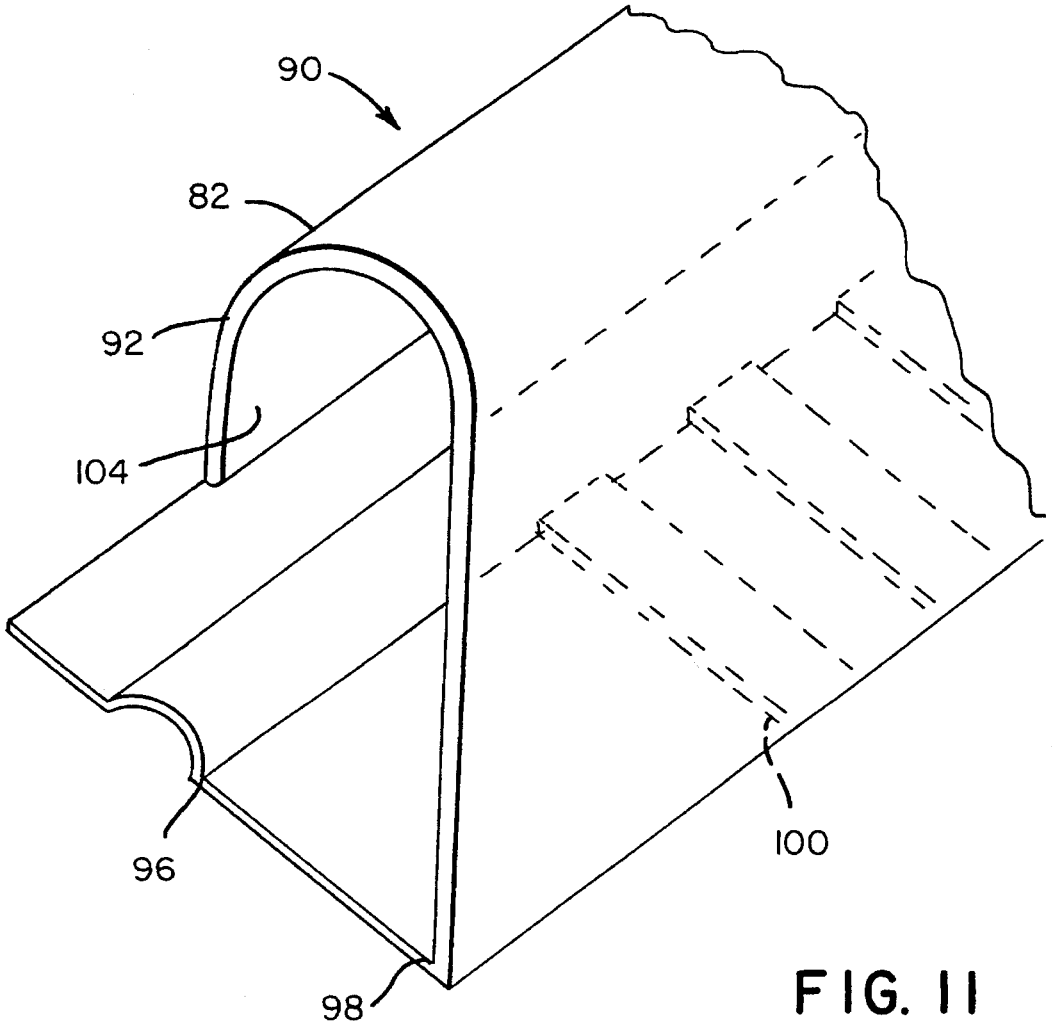
FIG. 11 shows a perspective view of a large end of a rail.
Figure 12:
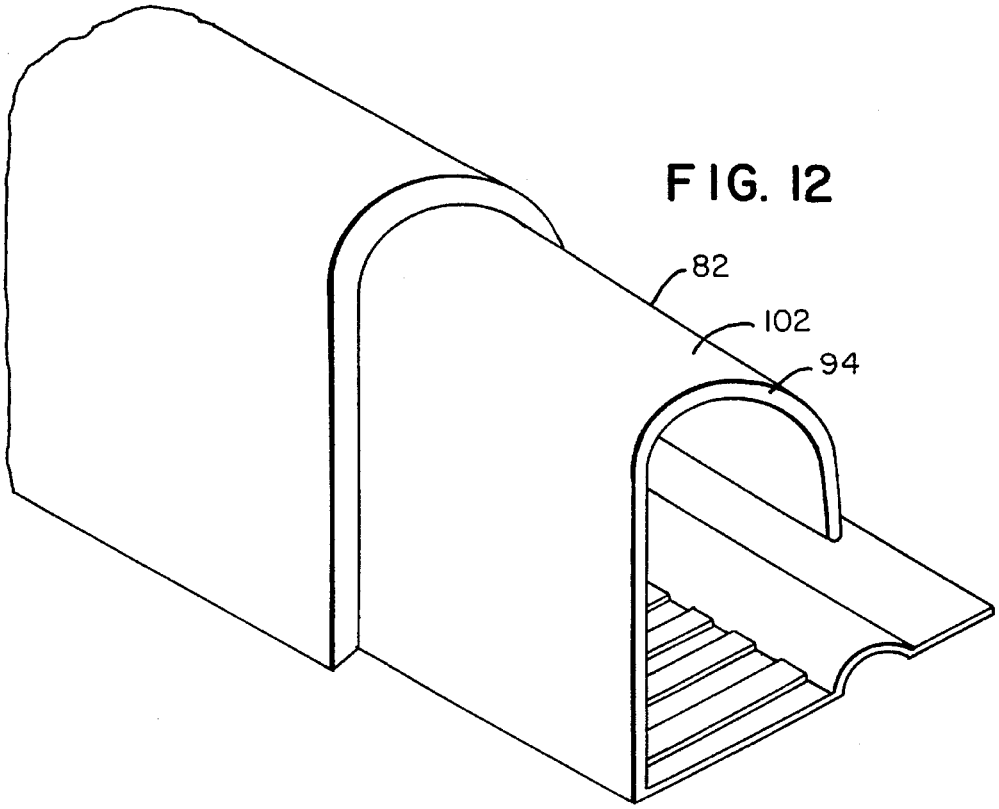
FIG. 12 shows a perspective view of a connection point of two rails.

The rails 70 come in a plurality of sections 90 so that the length and the course of the track 22 can be adjusted. Curved sections 90 can be provided so that an oval track course can be laid out. Referring now to FIG. 11, a perspective view of one rail 70 of a track section 90 is shown. Specfically the large end 92 of a rail 70 is shown. The large end 92 is adapted to receive the small end 94 (FIG. 12) of the connecting rail 70. The small end 94 is slidably received into the large end 92 of the rail between points 96 and 98 until it is flush with stop point 100. The outer surface 102 of of the small end 94 is frictionally engaged with the inner surface 104 of the large end 92 so as to provide a secure connection between connecting rails 70 as is shown in FIG. 12.

Figure 13:
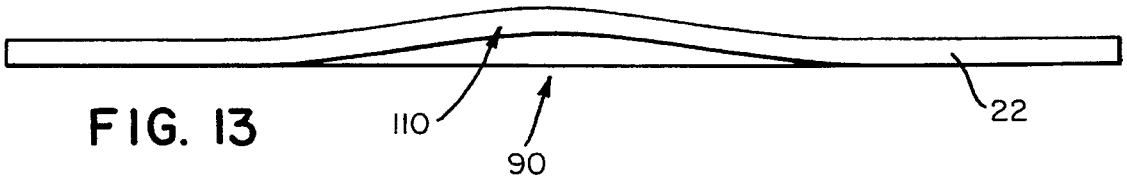
FIG. 13 shows a side view of a ramp section.

FIG. 13 shows a track section 90 having an inclined portion or ramp 110. This track section 90 is connected in the manner discussed above and can be added to provide a rolling terrain effect to the occupant.

Figure 14:
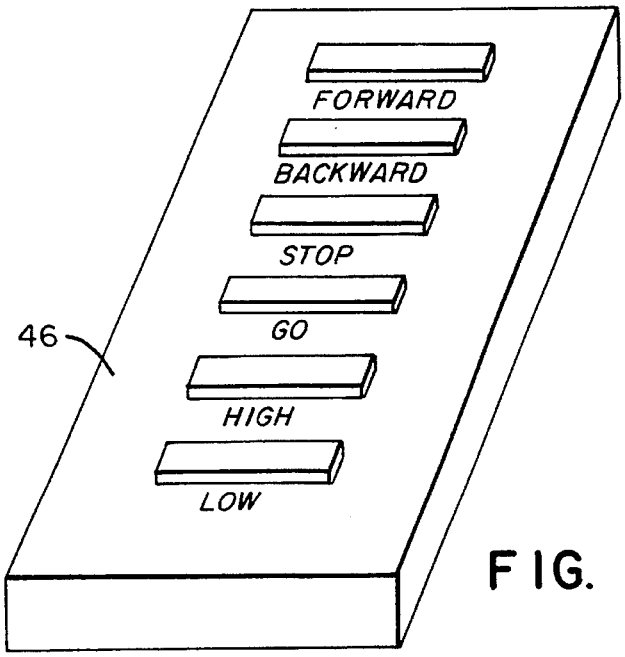
FIG. 14 shows a top view of the remote control.

FIG. 14 shows the remote control 46. The stop and go switches act as off and on switches for the motor 36. Either the forward or reverse switch is always engaged. The motor 36 is capable of operating at three speeds; an intermediate speed when the go switch is depressed, a fast speed when the high switch is depressed, and a slow speed when the low switch is depressed.

I claim:

1. A motorized vehicle assembly for infants comprising:

a Truck assembly having front and rear wheel assemblies extending downwardly therefrom, the front and rear wheel assemblies each having wheels connected thereto, said wheels having radially extending rectangular projections thereon for imparting vibration to said truck assembly;

a track assembly having two parallel rails, each of said rails being adapted to guide and limit the movement of said wheels, said rails having a series of regularly spaced rectangular projections for imparting additional vibration to said truck assembly;

a motor contained within the truck assembly and adapted to impart rotation to the wheels connected to the rear wheel assembly thereby causing the truck assembly to move along said rails, said motor connected to a remote control by a spring loaded cord assembly, said cord assembly serving to provide control signals to said motor from said remote control;

the truck assembly having a longitudinally extending top surface having fastening means connected thereto, the fastening means secured to at least three points along the length of the top surface, the fastening means securing an infant support device to said surface.

2. The vehicle of claim 1 where said truck assembly can operate in two directions along said track assembly.

3. The vehicle of claim 1 where said track assembly is reconfigurable.

4. The vehicle of claim 1 where said motor is operable by remote control.

5. The vehicle of claim 1 where said truck assembly includes a safety contact arrangement effective to disable the truck assembly upon contact with any object which impedes motion along the truck assembly.

* * * * *